US005104610A

United States Patent [19]

Bernardet et al.

[11] Patent Number: 5,104,610

[45] Date of Patent: Apr. 14, 1992

[54] DEVICE FOR PERFECTING AN ION SOURCE IN A NEUTRON TUBE

[75] Inventors: Henri Bernardet, Saint-Michel sur Orge; Xavier L. M. Godechot, Yerres; Claude A. Lejeune, Gif/Yvette, all of France

[73] Assignee: U.S. Philips Corporation, New York, N.Y.

[21] Appl. No.: 417,226

[22] Filed: Oct. 4, 1989

[30] Foreign Application Priority Data

Oct. 7, 1988 [FR] France ..... 88 13185

[51] Int. Cl.[5] ..... G21K 5/00

[52] U.S. Cl. ..... 376/116; 313/360.1; 250/423 R

[58] Field of Search ..... 376/117, 116, 115, 114, 376/111, 109, 108; 313/360.1, 361.1; 250/396 ML, 396 R, 423 R; 315/111.81

[56] References Cited

U.S. PATENT DOCUMENTS 2,806,161 9/1957 Foster, Jr. ..... 250/423 R
3,546,513 12/1970 Henning ..... 313/361.1
4,714,834 12/1987 Shubaly ..... 313/360.1
4,871,918 10/1989 Miljevic ..... 250/423 R

FOREIGN PATENT DOCUMENTS 1073941 6/1967 United Kingdom .

OTHER PUBLICATIONS

Pulsed Neutron Research, vol. II, 10–14 May 1965, pp. 609–622, "The generation of neutron pulses and modulated neutron fluxes with sealed off neutron tubes", Elenga et al.

Revue De Physigue Appliquee, vol. 12, No. 12, 12/77, pp. 1835–1848, Lejeune et al.

*Primary Examiner*—Daniel D. Wasil
*Attorney, Agent, or Firm*—Paul R. Miller

[57] ABSTRACT

The divergence of the magnetic field for confining the ionized gas (9) in a sealed high-flux neutron tube comprising a Penning-type ion source (1) is increased in the direction of the ion emission zone by influencing the magnet assembly (8) of the ion source. The ion beam extracted from the plasma is accelerated (2) and projected onto a target (4). The geometry and the position of the anode (13) inside the ion source are adapted to the topography of the lines of force in order to ensure minimum interception of the ionizing electrons moving in the structure, which adaptation is achieved notably by using a truncated anode whose generatrices take the shape of the lines of force.

3 Claims, 3 Drawing Sheets

DEVICE FOR PERFECTING AN ION SOURCE IN A NEUTRON TUBE

The invention relates to a high-flux neutron tube with an ion source comprising an anode and a cathode to form an ionised gas to be guided by a magnetic confinement field to be produced by field generating means, in order to generate a high-energy ion beam to be projected onto a target electrode by means of an extraction, and an acceleration device for producing therein a fusion reaction to cause an emission of neutrons.

BACKGROUND OF THE INVENTION

Neutron tubes of this kind are used in techniques for the examination of substances by means of fast, thermal, epithermal or cold neutrons. Such techniques include neutronography, analysis by activation, analysis by spectrometry of inelastic diffusions or radiative captures, diffusion of neutrons, etc.

In order to make these nuclear techniques as effective as possible, longer tube service lives are required for the corresponding emission levels.

The fusion reaction $d(3_H, 4_{He})$ in which supplies 14 MeV neutrons is most commonly used because of its large effective cross-section for comparatively low ion energies. However, regardless of the reaction used, the number of neutrons obtained per unit of charge in the beam always increases in proportion to the increase of the energy of the ions directed towards a thick target, that is to say mainly beyond ion energies obtained in the sealed tubes which are available at present and which are powered by a high voltage which does not exceed 250 kV.

Erosion of the target by ion bombardment is one of the principal factors restricting the service life of a neutron tube.

The erosion is a function of the chemical nature and the structure of the target on the one hand, and of the energy of the incident ions and their density distribution profile on the surface of impact on the other hand.

In most cases the target is formed by a hydride (titanium, scandium, zirconium, erbium, etc. . . . ) which is capable of binding and releasing large quantities of hydrogen without substantially affecting its mechanical strength; the total quantity bound is a function of the temperature of the target and of the hydrogen pressure in the tube. The target materials used are deposited in the form of thin layers whose thickness is limited by the problems imposed by the adherence of the layer to its substrate. One way of retarding the erosion of the target, for example, is to construct the absorbing active layer as a stack of identical layers which are isolated from one another by a diffusion barrier. The thickness of each of the active layers is in the order of magnitude of the penetration depth of deuterium ions striking the target.

Another method of protecting the target, thus increasing the service life of the tube, consists in the influencing of the ion beam so as to improve its density distribution profile on the surface of impact. For a constant total ion current on the target electrode, leading to a constant neutron emission, this improvement will result from an as uniform as possible distribution of the current density across the entire target surface exposed to the ion bombardment.

In a sealed neutron tube the ions are generally supplied by a Penning-type ion source which offers the advantage that it is robust, has a cold cathode (and hence a long service life), supplies large discharge currents for low pressures (in the order of 10 A/torr), and has a high extraction yield (from 20 to 40%) and small dimensions.

This type of source, however, has the drawback that it requires the use of a magnetic field of the order of a thousand gauss which introduces a substantial inhomogeneity of the density of the ion current inside the discharge and at the level of the ion emission zone.

SUMMARY OF THE INVENTION

It is the object of the invention to make the ion density more homogeneous at the emission level by modifying the known Penning construction.

To this end, in accordance with the invention the divergence of the magnetic field is increased in the direction of the ion emission zone by influencing the magnetic field producing means, modifications of confinement of the ionising electrons of the discharge and the resultant ionisation being compensated for by shape and/or the dimensions and/or anode position adaptation in the ion source.

This adaptation can be realised as follows:

- the anode is shaped so as to be truncated, its largest diameter being situated at the side of the low magnetic field values in order to take into account the divergence of the lines of force in the direction of the ion emission zone;
- the height of the circular anode is reduced and the anode is positioned nearer to the cathode in the zone of the magnetic field where a strong gradient occurs.

BRIEF DESCRIPTION OF THE DRAWINGS

The invention will be described in detail hereinafter with reference to the accompanying diagrammatic drawings.

Identical elements in the Figures are denoted by corresponding reference numerals.

DESCRIPTION OF THE INVENTION

Figure 1:
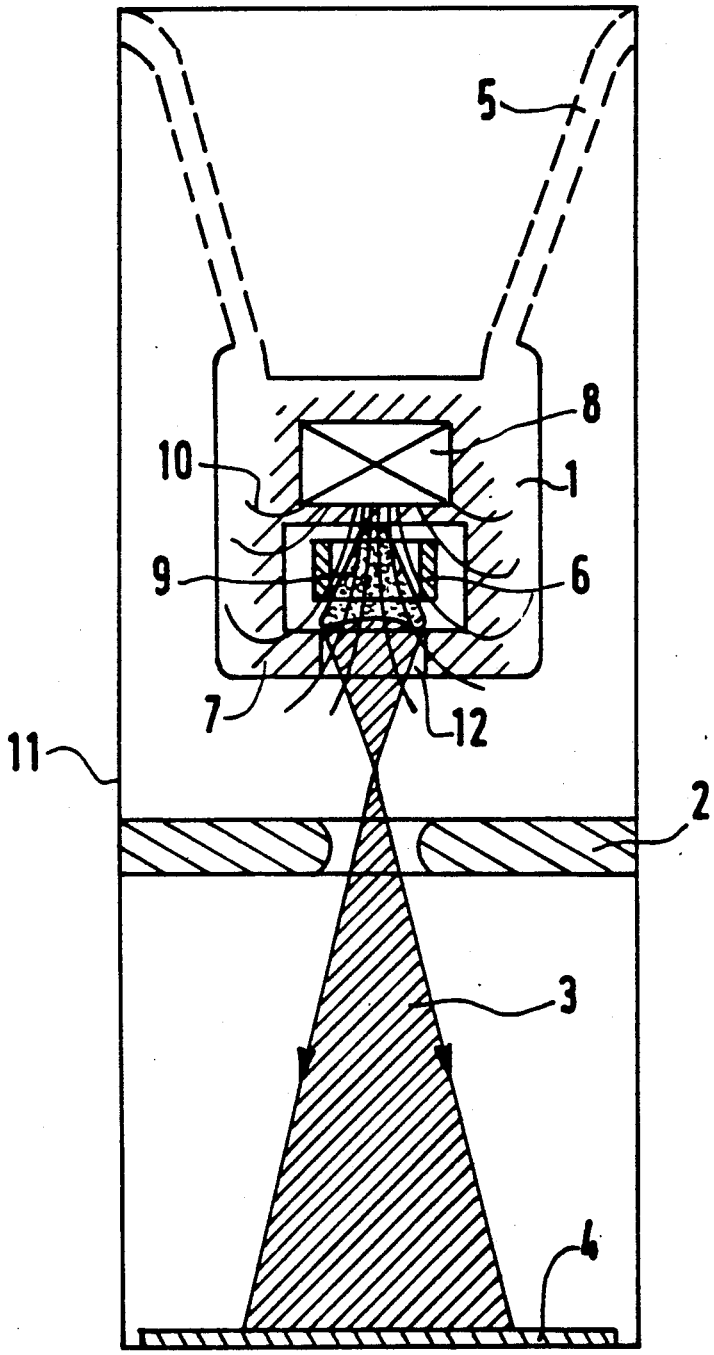
FIG. 1 PRIOR ART
FIG. 1 shows the circuit diagram of a prior art sealed neutron tube.

FIG. 1 shows the basic elements of a sealed neutron tube 11 which contains a low-pressure gaseous mixture to be ionised, for example deuterium-tritium, and which comprises an ion source 1 and an acceleration electrode 2 wherebetween a very high potential difference exists which enables the extraction and acceleration of the ion beam 3 and its projection onto the target 4 where the fusion reaction takes place which causes an emission of neutrons of, for example, 14 MeV.

The ion source 1 is integral with an insulator 5 for the passage of the high-voltage power supply connector (not shown) and, is for example a Penning-type source which is formed by a cylindrical anode 6, a cathode structure 7 which incorporates a magnet 8 with an axial magnetic field which confines the ionised gas 9 to the vicinity of the axis of the anode cylinder and whose lines of force 10 exhibit a given divergence. An ion emission channel 12 is formed in the cathode structure so as to face the anode.

The diagrams of FIG. 2 illustrate the target erosion effects.

Figure 2A:
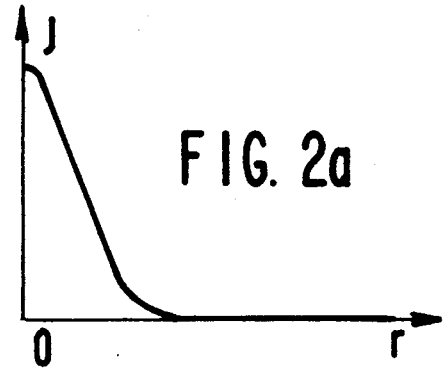
FIGS. 2*a*, 2*b*, 2*c* and 2*d* show the erosion effects in the depth of the target and the radial ion bombardment density profile.

FIG. 2*a* shows the density profile J of the ion bombardment in an arbitrary radial direction Or, starting from the point of impact 0 of the central axis of the beam on the surface of the target. The shape of this profile illustrates the inhomogeneous character of this beam where the very high density in the central part rapidly decreases towards the periphery.

Figure 2B:
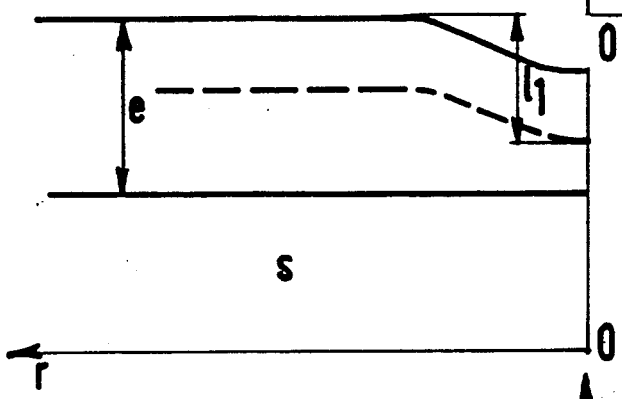

FIG. 2*b* shows the erosion as a function of the bombardment density and the entire hydride layer having a thickness e and deposited on a substrate S is saturated with the deuterium-tritium mixture. The penetration depth of the energetic deuterium-tritium ions, denoted by a broken line, equals a depth $l_1$ as a function of this energy.

Figure 2C:
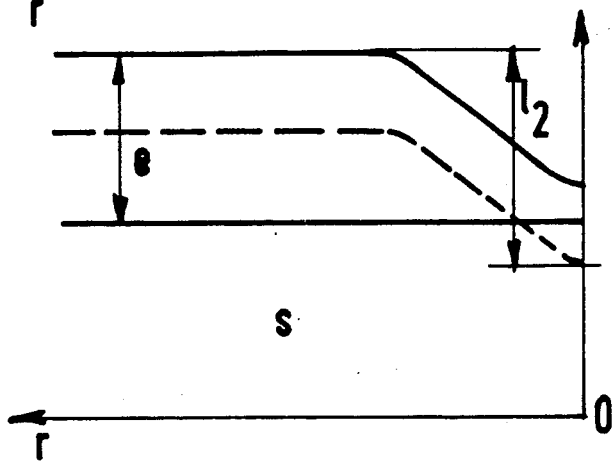

In FIG. 2*c* the erosion of the layer is such that the penetration depth $l_2$ is greater than the thickness e in the most heavily bombarded zone; a part of the incident ions propagates in the substrate and the deuterium and tritium atoms are very quickly oversaturated.

Figure 2D:
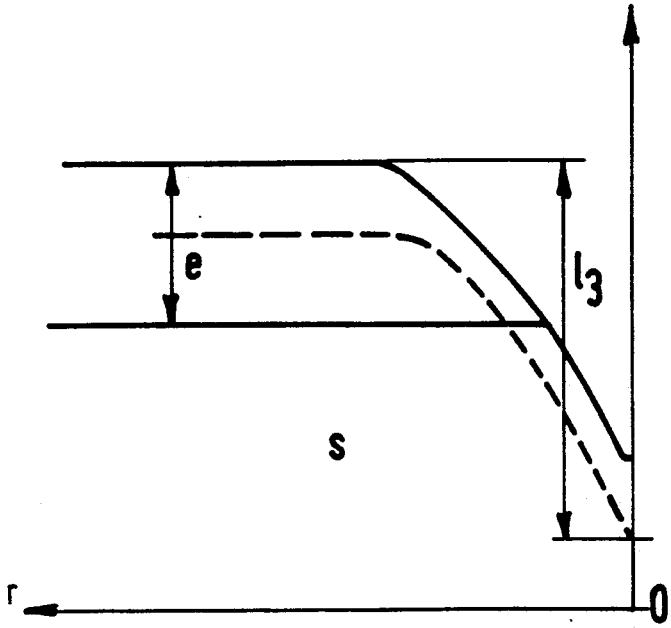

In FIG. 2*d* the deuterium and tritium atoms collect and form bubbles which form craters upon bursting and which very quickly increase the erosion of the target at the depth $l_3$.

The latter processes immediately precede the end of the service life of the tube, causing either a drastic increase of breakdowns (presence of microparticles resulting from the bursting of bubbles) or pollution of the target surface by the pulverised atoms which absorb the energy of incident ions.

In the Penning-type ion source 1 shown in FIG. 1, the cylindrical anode 6 is connected to a potential which is approximately 4 kV higher than that carried by the cathode 7 which is connected to a very high voltage of, for example 250 kV.

The magnet assembly 8 produces a strong magnetic field in the order of a thousand gauss.

This magnetic field serves to limit the transverse movement of the charges formed inside the anode by ionisation of a gaseous mixture of deuterium and tritium. This ionised gas is thus confined to the vicinity of the axis of the anode and has a much higher density along the axis. This results in a substantial inhomogeneity inside the discharge.

The ions are extracted from an emission channel 12 formed in the cathode, thus acting as the emission electrode, by means of the acceleration electrode 2 which is connected to ground potential 0 whereto as the target electrode 4 is also connected.

At the level of the ion extraction the inhomogeneity of the ionised gas will have more repercussions at the axis than at the periphery of the beam. Thus, this type of inhomogeneity largely contributes to the erosion of the target and hence to the limitation of the service life of the tube.

In order to make the ion density more homogeneous at the extraction level, the idea of the invention is to modify the confinement of the ionised gas by influencing the arrangement of the magnets of the assembly 8 so that the divergence of the magnetic field is greater. The resultant reduction of the discharge current can be attractively compensated for by means of the solutions illustrated by the FIGS. 3 and 4.

Figure 3:
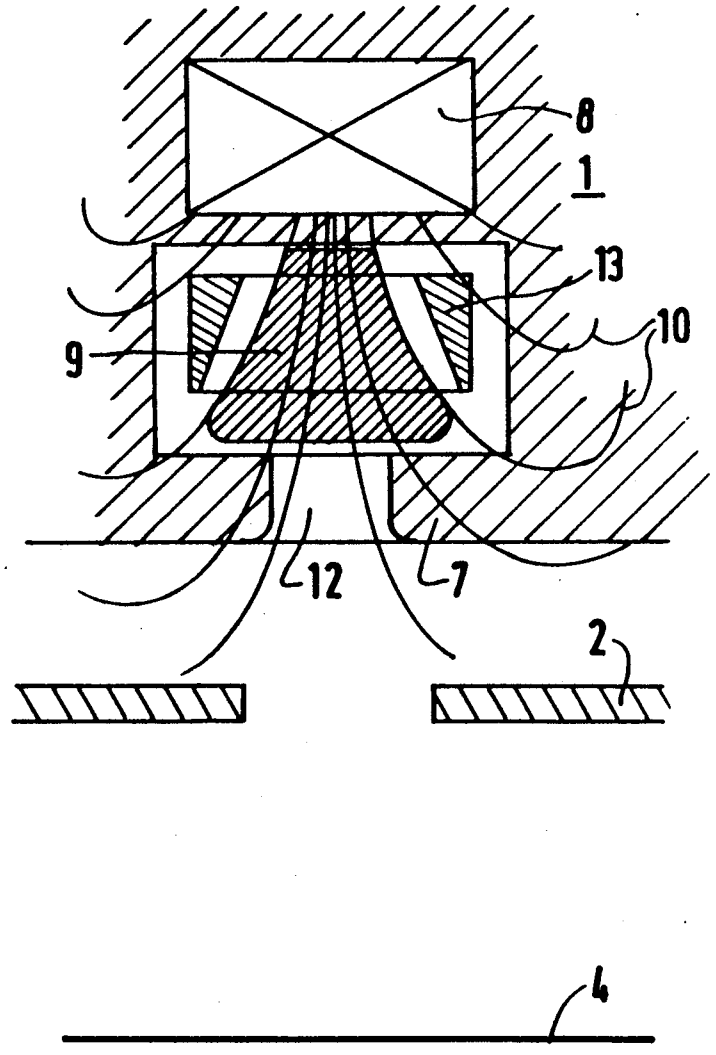

In FIG. 3 the circular anode has been replaced by a truncated anode 13 whose generatrices tend to take the shape of the lines of force of the magnetic field 10. The ionised gas 9 is wider because of this modification of the confinement. The diameters of the truncated anode will have to be increased in order to avoid the interception of electrons.

Figure 4:
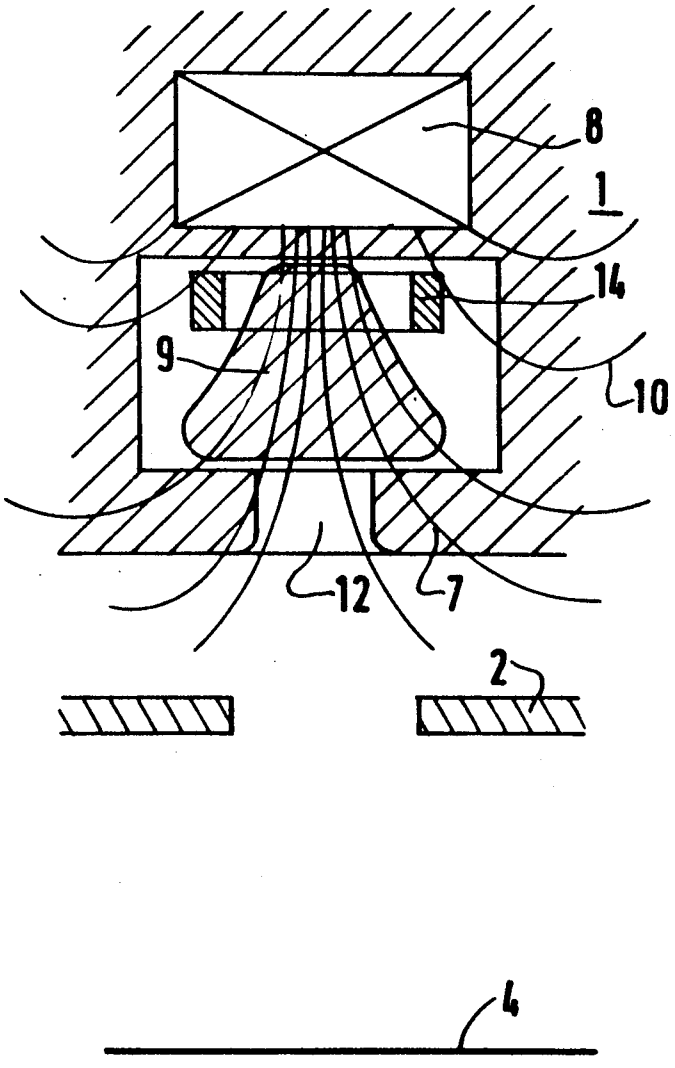
FIGS. 3 and 4 show portions of a first and a second version of the ion extraction device in accordance with the invention.

In FIG. 4 the height of the circular anode 14 has been reduced and the anode has been shifted nearer to the zone where a strong field prevails in the vicinity of the upper part of the cathode in order to avoid the interception of electrons.

These modifications ensure a substantial compensation for the discharge current and at the same time improve the homogeneity of the beam.

We claim:

1. A high flux neutron tube comprising (a) ion source means for producing a high energy ion beam, said ion source means including (i) cylindrical anode means for forming said ion beam, and (ii) a cathode structure having a cavity containing said cylindrical anode means, said cavity having an ion emission channel for emitting said ion beam, (b) magnetic means disposed in an axial direction before said ion source means for producing an axial magnetic field within said cavity and within said cylindrical anode means, (c) extraction and acceleration electrode means for extracting and accelerating said ion beam from said ion emission channel, (d) target electrode means receiving said ion beam from said extraction and acceleration electrode means for causing emission of neutrons by fusion reaction, and (e) means associated with said cylindrical anode means for increasing homogeneity of said ion beam across said ion emission channel upon increasing divergence of said magnetic field at said ion emission channel.

2. A high flux neutron tube according to claim 1, wherein said means for increasing homogeneity includes a truncated internal shape of said cylindrical anode means, said truncated internal shape having a first smaller internal diameter near said magnetic means and a second larger internal diameter near said ion emission channel such that lines of force of said magnetic field are spread outwardly before reaching said ion emission channel.

3. A high flux neutron tube according to claim 1, wherein said means for increasing homogeneity includes a circular cylindrical shape of said cylindrical anode means, said circular cylindrical shape having a reduced height and being situated closer to said magnetic means than to said ion emission channel such that lines of force of said magnetic field can spread outwardly before reaching said ion emission channel.

* * * * *